US005113167A

United States Patent [19]

Raudabaugh

[11] Patent Number: 5,113,167

[45] Date of Patent: May 12, 1992

[54] LIGHTNING ARRESTER ISOLATOR

[75] Inventor: Donald E. Raudabaugh, Wadsworth, Ohio

[73] Assignee: Hubbell Incorporated, Orange, Conn.

[21] Appl. No.: 656,002

[22] Filed: Feb. 15, 1991

[51] Int. Cl.[5] ..... H01H 39/00; H01H 83/10

[52] U.S. Cl. ..... 337/30; 337/4; 337/16; 361/125

[58] Field of Search ..... 337/4, 14, 15, 16, 17, 337/18, 19, 20, 28, 29, 30, 31, 32, 33, 34, 35; 361/117, 124, 125, 131

[56] References Cited

U.S. PATENT DOCUMENTS 2,305,436 12/1942 McMorris .
2,820,869 1/1958 Hedlund et al. .
2,957,967 10/1960 MacRae .
2,989,608 6/1961 Hicks .
3,017,539 1/1962 Robinson .
3,100,246 8/1963 Riley .
3,239,631 3/1966 Snell, Jr. .
3,291,937 12/1966 Carothers et al. .
3,588,773 6/1971 Carothers .
3,668,458 6/1972 Irie et al. .
3,679,938 7/1972 Carothers et al. .
3,702,419 11/1972 Carothers et al. .
3,869,650 3/1975 Cunningham et al. .
4,204,238 5/1980 Stetson .
4,479,105 10/1984 Banes .
4,503,414 3/1985 Sykes et al. .
4,538,133 8/1985 Pflanz ..... 337/4
4,734,823 3/1988 Cunningham .

FOREIGN PATENT DOCUMENTS 1583913 2/1981 United Kingdom .

*Primary Examiner*—Harold Broome
*Attorney, Agent, or Firm*—Jerry M. Presson; Alfred E. Goodman

[57] ABSTRACT

A device for isolating an arrester has first and second electrical terminals mechanically and electrically coupled together. The electrical connection includes a mechanism for automatically interrupting the electrical connection and creating a spark gap. A gas generating device is provided for physically and electrically separating the first and second terminals subsequent to creation of a spark.

18 Claims, 1 Drawing Sheet

LIGHTNING ARRESTER ISOLATOR

CROSS REFERENCE TO RELATED APPLICATIONS

The subject matter of this application is related to U.S. Pat. application Ser. No. 07/655,026 of Donald E. Raudabaugh entitled Arrester Isolator-Disconnector, filed concurrently herewith. The subject matter of the related application is hereby incorporated herein by reference.

1. Field of the Invention

The present invention relates to a device for isolating an arrester connected between a power line and ground. More particularly, the present invention is a device having a pair of electrical terminals with a circuit therebetween. The circuit includes a mechanism for automatically interrupting the circuit and creating a spark gap upon arrester failure.

2. Background of the Invention

Lightning or surge arresters are typically connected to power lines to carry electrical surge currents to ground and, thus, prevent damage to the lines and equipment connected thereto. Arresters offer high resistance to normal voltage across power lines, yet offer very low resistance to surge currents produced by sudden high voltage conditions caused by lightning strikes, for example. After the surge, the voltage should drop and the arrester should then normally return to a high resistance state. However, in the case of arrester malfunction or failure, the high resistance state is not resumed, and the arrester continues to provide an electrical path from the power line to ground. Ultimately, the line will fail due to a short circuit condition or breakdown of the distribution transformers, and the arrester will require replacement.

To avoid line failure, disconnectors or isolators are commonly used in conjunction with arresters to separate a malfunctioning arrester from the circuit and provide visual indication of arrester failure. Conventional isolators have an explosive charge to destroy the circuit path and physically separate the electrical terminals. Upon exploding, however, some prior disconnectors propelled parts of the device at high velocity into the surrounding area endangering persons and property in the vicinity. In addition, fragile housings, used to ensure disconnection upon detonation, often broke during installation. Other prior disconnectors did not generate enough explosive force to break the circuit.

Examples of prior disconnector and isolator devices are disclosed in U.S. Pat. No. 2,305,436 to McMorris; U.S. Pat. No. 2,820,869 to Hedlund et al.; U.S. Pat. No. 2,957,967 to MacRae; U.S. Pat. No. 2,989,608 to Hicks; U.S. Pat. No. 3,017,539 to Robinson; U.S. Pat. No. 3,100,246 to Riley; U.S. Pat. No. 3,239,631 to Snell, Jr.; U.S. Pat. No. 3,291,937 to Carothers et al.; U.S. Pat. No. 3,588,773 to Carothers; U.S. Pat. No. 3,668,458 to Irie et al.; U.S. Pat. No. 3,679,938 to Carothers et al.; U.S. Pat. No. 3,702,419 to Carothers et al.; U.S. Pat. No. 3,869,650 to Cunningham et al.; U.S. Pat. No. 4,204,238 to Stetson; U.S. Pat. No. 4,479,105 to Barnes; U.S. Pat. No. 4,503,414 to Sykes et al.; and U.S. Pat. No. 4,738,823 to Cunningham.

SUMMARY OF THE INVENTION

An object of the present invention is to provide a device that reliably and sufficiently disconnects and isolates a malfunctioning arrester from ground and avoids disconnection before arrester failure.

Another object of the present invention is to provide a device that is durable and strong enough to withstand handling during installation.

A further object of the present invention is to provide a device which blows apart without shattering.

Still another object of the present invention is to provide a device which produces sufficient explosive force to completely disconnect and isolate an arrester from the circuit.

The foregoing objects are basically attained by a device for isolating an arrester, comprising a first electrical terminal, a second electrical terminal, a mechanical mechanism for connecting the first and second terminals and a electrical mechanism for electrically connecting the first and second terminals. The electrical mechanism includes an interrupting device for automatically interrupting the electrical connection and creating a spark gap. A gas generating mechanism is also provided for physically and electrically separating the first and second terminals in response to generation of a spark.

The foregoing objects are further obtained by a device for isolating an arrester, comprising a first electrical terminal, a second electrical terminal, a mechanical mechanism for connecting the first and second terminals and a electrical mechanism for electrically connecting the first and second terminals including a flexible plate automatically movable between an electrical contacting position and a spark gap position. A disconnecting device is also provided for automatically separating the first terminal from the second terminal subsequent to the plate moving to the spark gap position.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
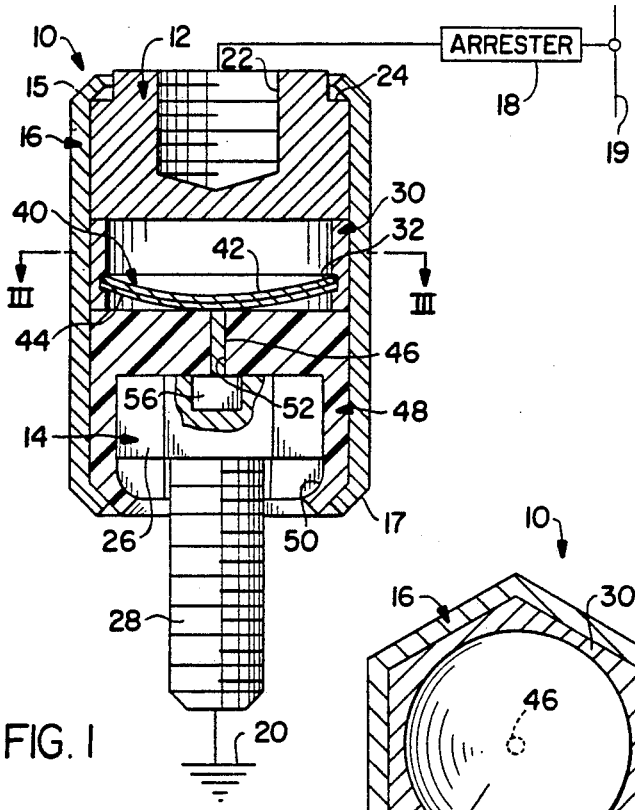
FIG. 1 is a side elevational view in section of a device in accordance with the present invention in the electrical contacting position.
Figure 2:
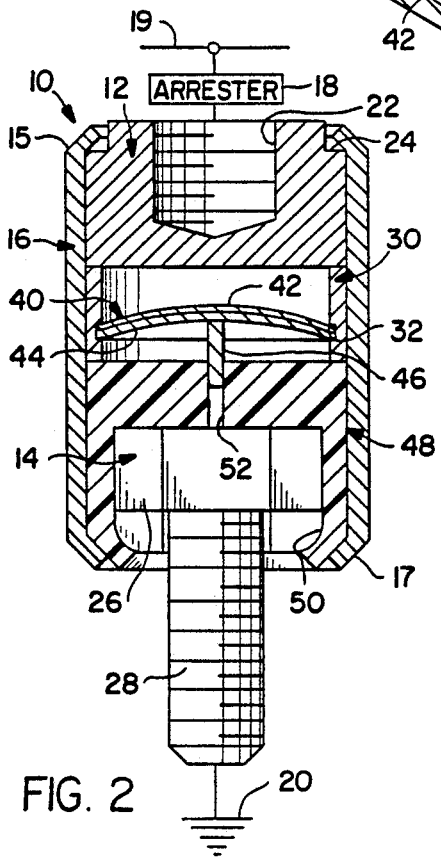
FIG. 2 is a side elevational view in section of the device according to the present invention in the spark gap position.

Referring initially to FIG. 1, a device 10 for isolating an arrester 18 is illustrated in accordance with the present invention, and includes a first female electrical terminal 12 and second male terminal 14 mechanically coupled by hollow tubular casing 16. First or upper terminal 12 is electrically connected to arrester 18 in a power system, and second or lower terminal 14 is electrically connected to ground 20, as shown in FIGS. 1 and 2. Arrester 18 is connected to power line 19 which is representative of the power system.

In the preferred embodiment, first terminal 12 is configured as a female terminal in the form of a hexagonal prism having an internally threaded bore 22 and an annular shoulder 24. When viewed in transverse cross section, bore 22 is circular, while the exterior shape of terminal 12 is hexagonal. Lower, second terminal 14 has an enlarged hexagonal head 26 and a cylindrical externally threaded body 28. Both terminals are electrically conductive and preferably formed of stainless steel. First terminal 12 may be configured as a male terminal similar to second terminal 14, if desired.

Figure 3:
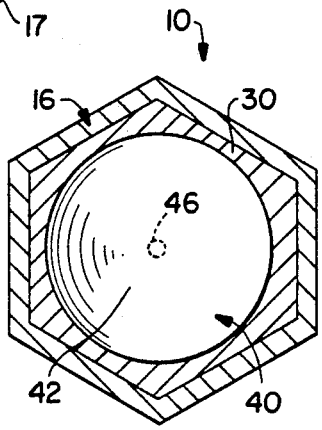
FIG. 3 is a top plan view in section of the device as shown in FIG. 1 taken along line III—III.

Surrounding at least a portion of terminals 12 and 14 is electrically conductive casing 16 which is configured as a hollow tube with a first end 15 and a second end 17. Casing 16 has a hexagonal cross section as shown in FIG. 3 and is preferably formed of aluminum.

A retainer 30 is located within casing 16 and abuts terminal 12. As shown in FIG. 3, retaining member 30 is a ring shaped member having a hexagonal exterior cross section and circular interior cross section; i.e., the retainer member's outer surface is a hexagonal prism, while its inner surface is a right circular cylinder. Formed in the interior cylindrical wall of retaining member 30, adjacent to and spaced from its lower end, is an interior annular groove 32. Retaining member 30 is also conductive and preferably formed of stainless steel.

Flexible plate 40 is held within retaining member 30 by interior groove 32. Plate 40 is a circular snap-disc formed of a bimetallic alloy and has a larger exterior diameter than the interior diameter of groove 32 in retaining member 30. Plate 40 is held tightly within retaining member 30 by an interference fit between the edges of plate 40 and annular groove 32. Plate 40 is mechanically biased in an upwardly concave position by groove 32 which prevents axial movement and partial deflection of plate 40 at lower, normal currents encountered by the isolator. Since a spark gap must not be created at normal currents, plate 40 should not deform even slightly until higher currents are encountered. Upon encountering such higher currents, plate 40 must snap over decisively and irreversibly.

The upper layer or high side 42 of plate 40 has a high coefficient of thermal expansion and, in the preferred embodiment, is formed of 72 percent manganese, 18 percent copper and 10 percent nickel by weight. The bottom layer or low side 44 has a lower coefficient of thermal expansion and, in the preferred embodiment, is formed of 36 percent nickel and 64 percent iron by weight. Plate 40 is electrically coupled to first terminal 12 via retaining member 30.

Extending from low side 44 of plate 40 is an electrically conductive contact member 46. Contact member 46 is an elongated pin secured to the center of low side 44 of plate 40.

An insulating member 48 is located between retaining member 30 and second terminal 14. Insulating member 48 is a thermoplastic block having a hexagonal exterior cross section and an internal hexagonal cup-shaped cavity 50. Cup-shaped cavity 50 receives lower, second terminal 14 and insulates lower terminal 14 from casing 16. Extending through the base of cavity 50 to the exterior top of insulating member 48 is a through-bore 52 which receives pin 46. Insulating member 48 is preferably made of acetal which is a very strong and stiff thermoplastic characterized by good fatigue life, resilience, low moisture sensitivity, high solvent and chemical resistance and good electrical properties. Acetal resins evolve gas when exposed to high temperatures.

Assembly

Figure 4:
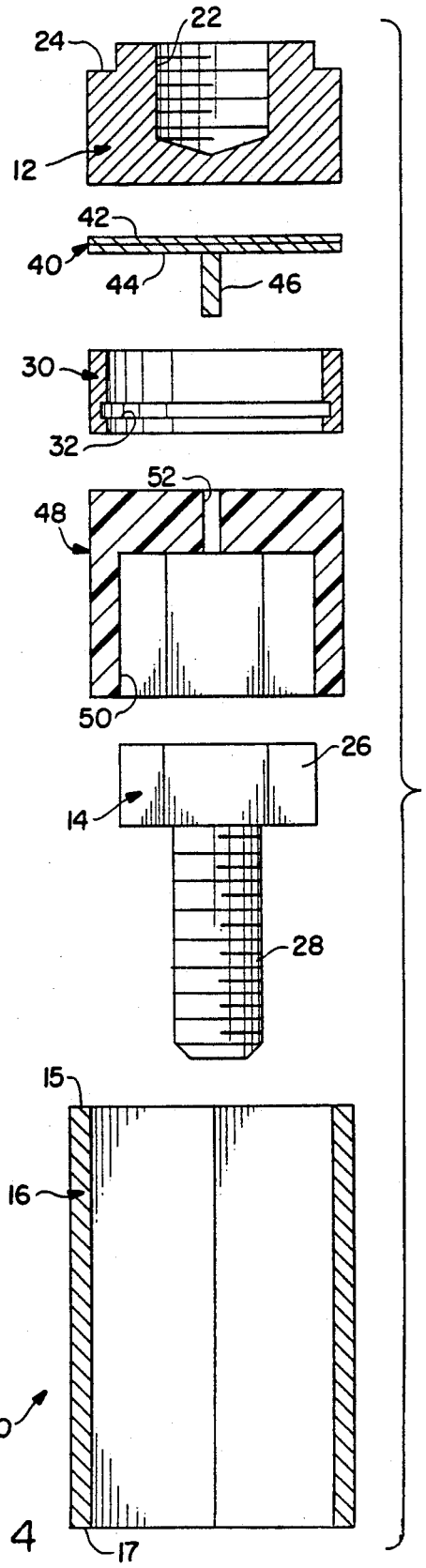
FIG. 4 is an exploded side elevational view in section of the device as shown in FIG. 1.

Initially, plate 40 is flat as shown in FIG. 4. During assembly, plate 40 is inserted into retaining member 30 by flexing plate 40 into an upwardly concave position and sliding it into retaining ring 30 until the circular edge of plate 40 is held within groove 32. Retaining member 30, with plate 40 retained in an upwardly concave position with contact member 46 protruding downwardly, is then placed on insulating member 48 with contact member 46 extending into bore 52. Upper electrical terminal 12 is placed on retaining member 30 and lower electrical terminal 14 is inserted into cavity 50 of insulating member 48. The assembled components are held within hollow casing 16. First end 15 is crimped around annular shoulder 24 of terminal 12, while second end 17 is crimped around the edges of cavity 50, bending insulating member 48 slightly inwardly as shown in FIGS. 1 and 2. In the initially assembled position, contact member 52 is electrically connected to head 26 of terminal 14 as shown in FIG. 1.

Operation

Once assembled, arrester isolator device 10 is electrically connected to arrester 18 via electrical terminal 12 and to ground 20 via electrical terminal 14. Steady state arrester currents are usually less than one milliampere and travel through device 10 without tripping plate 40. However, when exposed to lightning or switching surge currents, the arrester 18 experiences extremely high pulse currents which also travel through device 10. Lightning charges and switching surges result in high current, short duration pulses which last usually less than 100 micro seconds for lightning and less than several milliseconds for switching surges. If arrester 18 fails to withstand system voltage, short circuit currents of tens to tens of thousands of amperes may flow through the faulted arrester passing through isolator 10 to ground 20.

The circuit through device 10 includes first electrical terminal 12, retaining member 30, plate 40, contact member 46 and second electrical terminal 14. As seen in FIGS. 1 and 2, electrical terminal 14 is insulated from casing 16 by the walls of cavity 50 in insulating member 48.

High current flowing through plate 40 for periods longer than normal lightning or switching surges result in electrical resistance heating of plate 40. The high side 42 of plate 40, having a high coefficient of thermal expansion, exhibits a higher rate of mechanical activity per degree of temperature than low side 44, causing high side 42 to expand at a greater rate than low side 44. Since plate 40 has been loaded into retaining ring 30 in a upwardly concave position with high side 42 disposed on the upper side, the expansion forces cause plate 40 to snap over into an upwardly convex position expanding high side 42 as shown in FIG. 2. Groove 32 holds plate 40 in place within retainer member 30 after snap over occurs.

The automatic movement of plate 40 causes contact member 46 to break connection with enlarged head 26 of second electrical terminal 14 and interrupt the circuit, thus forming a spark gap in bore 52 as seen in FIG. 2. At currents exceeding 1500 amperes, the disk 42 will snap over center, drawing an arc between contact member 46 and electrical terminal 14. The arc generated in bore 52 then creates heat which generates gas from acetal insulating member 48. The gas further opens the electrode gap and subsequent current flow increases gas pressure within the casing 76, forcing terminals 12 and 14 to physically separate. The pressure created within device 10 blows the components apart by forcing one or both terminals to shoot out of casing 16 by deforming crimped end 15 and/or 17. The explosive effect of the built up gas pressure forcing at least one terminal out of casing 16 effectively isolates arrester 18.

Snap-disc plate 40 may also be used as an arc initiator in an isolator containing an explosive cartridge 56. In this case, the cartridge would replace or be used in addition to the acetal gas generator, insulating member 48. In such a device, a 0.22 caiiber cartridge is commonly used as the explosive device. The cartridge 56 would be encased in the head 26 of terminal 14 as graphically illustrated in FIG. 1. Contact member 46 would electrically and physically contact the casing of the cartridge. Upon snap over of bimetallic plate 40, an arc drawn between the cartridge and contact member 46 would explode the cartridge, thus generating gas, heat and pressure, and force terminals 12 and 14 to separate, isolating the arrester from ground.

It is contemplated that plate 40, which acts as means for automatically interrupting the electric circuit by creating a spark gap, could be configured as a bimetallic hair pin.

While one embodiment has been chosen to illustrate the invention, it will be understood by those skilled in the art that various changes and modifications can be made therein without departing from the scope of the invention as defined in the appended claims.

What is claimed is:

1. A device for connecting and isolating an arrester between a power line and ground, comprising:

a first electrical terminal;

a second electrical terminal;

casing means for mechanically connecting said first and second terminals;

electrical means for electrically connecting said first and second terminals, said electrical means including interrupting means for automatically interrupting said electrical means and creating a spark gap; and gas generating means, adjacent said interrupting means, for physically and electrically separating said first and second terminals subsequent to creation of said spark gap.

2. A device according to claim 1, wherein said gas generating means is acetal.

3. A device according to claim 1, wherein said gas generating means is a member with a bore therethrough and said spark gap is located in said bore.

4. A device according to claim 1, wherein said interrupting means comprises a flexible plate.

5. A device according to claim 4, wherein said plate is bi-metallic.

6. A device according to claim 4, and further comprising means for retaining said plate in a position electrically connected to said first and second terminals.

7. A device according to claim 6, wherein said means for retaining said plate includes a retaining member having a groove, said groove receiving said plate in an interference fit.

8. A device according to claim 1, wherein said interrupting means comprises a snap-disc.

9. A device according to claim 1, wherein said interrupting means comprises a flexible plate movable between a concave position and a convex position.

10. A device according to claim 9, wherein said plate has an electrical contact member extending therefrom, contacting said second terminal when said plate is in said concave position and spaced from said second terminal by said spark gap when said plate is in said convex position.

11. A device according to claim 10, wherein said gas generating means is a non-conductive block disposed between said plate and said second terminal and has a through-bore through which said contact member extends.

12. A device according to claim 10, wherein said gas generating means is an explosive cartridge.

13. A device according to claim 9, wherein said plate is bi-metallic.

14. A device according to claim 1, wherein said gas generating means is a non-conductive block disposed between said interrupting means and said second terminal.

15. A device according to claim 1, wherein said interrupting means includes a flexible conductive plate with a contact member thereon, said second electrical terminal being in electrical contact with said contact member.

16. A device according to claim 15, and further comprising a retaining member receiving and holding said plate in a curved configuration, said retaining member electrically coupled to said first terminal;

an insulating member disposed between said plate and said second terminal; and hollow casing disposed around said first terminal, said plate, said retaining member, said insulating member and said second terminal, said casing being electrically insulated from said second terminal by said insulating member.

17. A device for isolating an arrester comprising:

a first electrical terminal;

a second electrical terminal;

casing for mechanically coupling said first terminal to said second terminal;

an electrically conductive retaining member having holding means and being electrically coupled to said first terminal;

a flexible bi-metallic plate electrically coupled to said retaining member and being held in an upwardly concave position by said holding means;

a electrically conductive contact member connected to said plate and extending toward and contacting said second terminal; and an acetal block having a bore therethrough, and being located between said plate and said second terminal, said contact member extending through said bore.

18. A device for isolating an arrester comprising:

a first electrical terminal;

a second electrical terminal;

casing for mechanically coupling said first terminal to said second terminal;

an electrically conductive retaining member having holding means and being electrically coupled to said first terminal;

a flexible bi-metallic plate electrically coupled to said retaining member and being held in an upwardly concave position by said holding means;

a electrically conductive contact member connected to said plate and extending toward and contacting said second terminal; and an explosive cartridge means encased in said second terminal.

* * * * *